United States Patent [19]

Yoshimoto et al.

[11] 4,257,829

[45] Mar. 24, 1981

[54] METHOD FOR COOLING AN ALUMINUM STRIP DURING THE PROCESS OF HEAT TREATMENT

[75] Inventors: Hiromu Yoshimoto, Chita; Michitoshi Okumura, Kasugai; Kenji Kawate, Nagoya, all of Japan

[73] Assignee: Daidotokushuko, Japan

[21] Appl. No.: 55,869

[22] Filed: Jul. 9, 1979

[30] Foreign Application Priority Data

Jul. 15, 1978 [JP] Japan ..... 53-86558

[51] Int. Cl.[3] ..... C22F 1/04

[52] U.S. Cl. ..... 148/13; 148/20.3

[58] Field of Search ..... 148/13, 20.3

[56] References Cited

U.S. PATENT DOCUMENTS 3,262,822 7/1966 Griffith ..... 148/13

*Primary Examiner*—R. Dean

*Attorney, Agent, or Firm*—William A. Drucker

[57] ABSTRACT

During the process of movement of an aluminum strip in a floating mode, the strip is first heated and then cooled for the annealing. In cooling the aluminum strip, the aluminum strip is first cooled to a predetermined temperature at an easy cooling temperature gradient, and subsequently cooled to a room temperature at a sharper cooling temperature gradient than the former. During the process of the cooling, a significant thermal stress is not produced in the aluminum strip, and the aluminum strip is cooled without being wrinkled.

4 Claims, 11 Drawing Figures

METHOD FOR COOLING AN ALUMINUM STRIP DURING THE PROCESS OF HEAT TREATMENT

BACKGROUND OF THE INVENTION

1. Field of the Invention

This invention relates to a method for cooling an aluminum strip heated for annealing.

2. Description of the Prior Art

In prior arts, in the case where an aluminum strip (The aluminum strip herein termed is a thin and lengthy bandlike aluminum plate continuously rolled by a rolling mill. The thickness of the aluminum plate is normally less than 3 mm, and the plate has various widths.) is subject to heat treatment for the annealing, the aluminum strip in the form of a coil is introduced into a batch type furnace such as a bell type furnace and annealed in a well-known method. In accordance with this method, since the strip is wound into a coil-like form, there is a one portion, i.e., the surface which tends to be affected by heat, and the other portion, i.e., the central portion which is hard to be affected by heat so that the quality therebetween is uneven.

A method has been proposed in order to overcome such a drawback noted above, which method comprises paying off successively an aluminum strip in the form of a coil from one end thereof, passing the paid-off strip in its floating condition through a heating zone to heat the strip to a temperature as indicated at 51 in FIG. 9, and passing it through a cooling zone to cool the strip to a temperature as indicated at 52 in FIG. 9. However, if the aluminum strip used is thin, it has a low elastic limit. Therefore, when such a thin strip is heated and cooled by the method as described above, thermal stress as shown in FIG. 10 occurs in the strip and the thermal stress exceeds the elastic limit, as a consequence of which strain, namely, wrinkles in parallel with the moving direction of the strip, in other words, the longitudinal wrinkles 53 as shown in FIG. 11 appear, thus giving rise to difficulties in that the products are diminished in value.

SUMMARY OF THE INVENTION

It is therefore an object of the present invention to provide a cooling method which in cooling the heated aluminum strip, can minimize the stress produced within the aluminum strip.

In accordance with the present invention, accordingly, rational heat treatment can be applied even to an extremely thin aluminum strip which produces a strain readily, while restraining occurrence of strain, in a floating condition and continuously efficiently operating condition.

BRIEF DESCRIPTION OF THE DRAWINGS

FIGS. 9 through 11 show conventional examples, in which FIGS. 9 and 10 are graphic representations similar to those shown in FIGS. 4 and 5, respectively, and FIG. 11 is a view showing a state wherein wrinkles have appeared in the aluminum strip.

DESCRIPTION OF THE PREFERRED EMBODIMENTS

Figure 1:
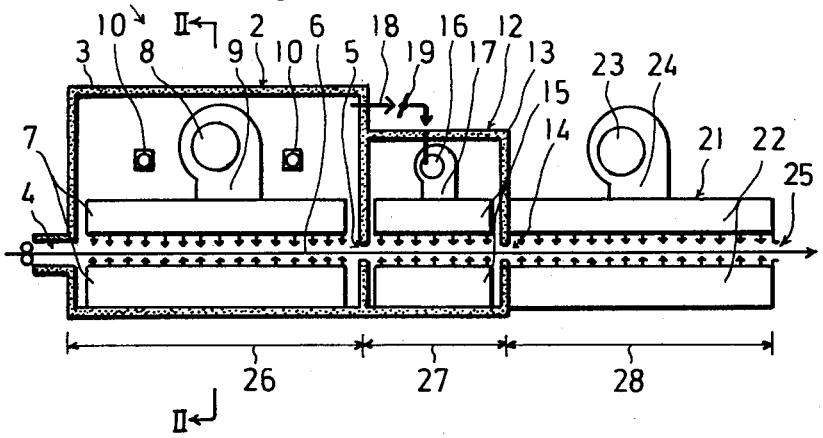
FIG. 1 is a schematic longitudinal sectional view of a heat treatment apparatus.
Figure 2:
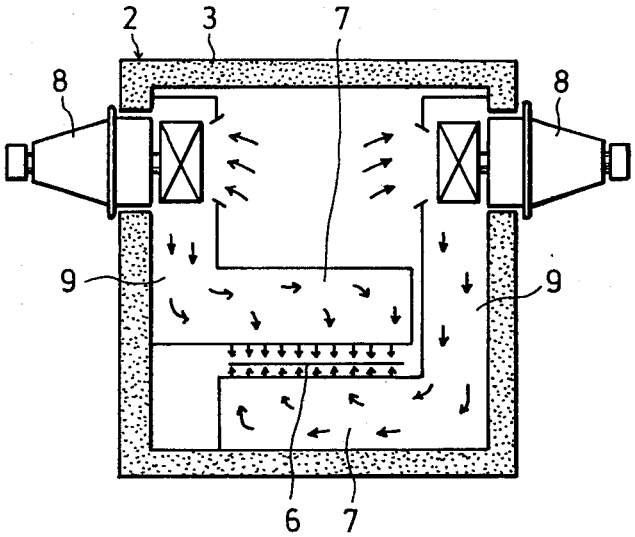
FIG. 2 is an enlarged sectional view of the apparatus taken on line II—II.

Referring now to FIG. 1, there is shown a heat treatment apparatus 1 which comprises a heating apparatus 2, a slow cooling apparatus 12, and a cooling apparatus 21. First, the heating apparatus 2 will be described. This heating apparatus 2 is shown in transverse section in FIG. 2. A furnace wall 3 is designed to form a heat shield between the interior and exterior thereof in a known manner. The furnace wall 3 is partly provided with an entrance port 4 and a reception port 5. An aluminum strip 6 is inserted through the entrance port 4 and reception port 5 as shown. Plenum chambers 7, 7 are provided in a space interiorly of the furnace wall 3. These plenum chambers 7, 7 are located in opposed position and the aluminum strip 6 passes between them. On the surfaces opposed to each other in the plenum chambers 7, 7 there are disposed a plurality of gas blowing nozzles in a known manner. A recirculation fan 8 is mounted on the furnace wall 3. A conduit 9 has one end communicated with the circulation fan 8, and the other end communicated with the plenum chamber 7. Further, a burner 10 is disposed internally of the furnace wall 3.

Next, the slow cooling apparatus 12 will be described. Similarly to the heating apparatus 2, the slow cooling apparatus is composed of a furnace wall 13, a reception port 14, plenum chambers 15, 15, a circulation fan 16, a conduit 17, and the like. A supply tube for hot gas 18 has one end communicated with a suction hole of the circulation fan 16. The supply tube for hot gas 18 has the other end open to the space within the furnace wall 3 of the heating apparatus 2 so that the hot gas (combustion waste gas from the burner 10) within the furnace wall 3 may be supplied toward the circulation fan 16. A flow controlling damper 19 is disposed in the midst of the supply tube for hot gas 18.

Next, the cooling apparatus 21 will be described. The cooling apparatus 21 is composed of plenum chambers 22, 22, a blower 23, a conduit 24, and the like, similarly to the abovementioned heating apparatus 2 with the exception of provision of the furnace wall for the heat shielding, burner, and the like, as in the heating apparatus. A discharge port 25 for the strip 6 is provided between the plenum chambers 22, 22.

Figure 3:
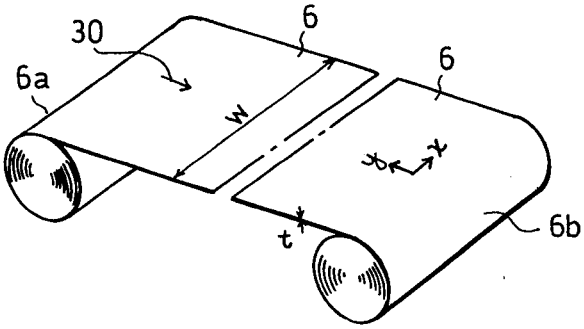
FIG. 3 is a schematic perspective view of an aluminum strip wherein the latter is paid off and rewound.

In the following, the operation will be explained. An aluminum strip **6*a* wound around a pay off reel as shown in FIG. 3 is paid off as indicated by the arrow 30 in a known manner. The thus paid off aluminum strip 6 passes through various known devices, after which it is passed through the heat treatment apparatus 1. The aluminum strip 6 issued from the heat treatment apparatus 1 passes through various known devices, after which it is wound around the rewind reel as shown at 6*b***.

In a state where the aluminum strip 6 is passed through the heat treatment apparatus as previously mentioned, the burner 10, fans 8, 16 and 23 are driven. In the steady condition, the aluminum strip 6 is held floated between the plenum chambers 7, 7, between the plenum chambers 15, 15, and between the plenum chambers 22, 22 by the hot gases (in the chamber 22, normal air not heated) blown through the nozzles in these chambers. It is noted that the fans, chambers and the like in the heating apparatus 2, slow cooling apparatus 12, and cooling apparatus 21 are designed so as to provide functions as described above and to provide characteristics of increasing and decreasing temperatures of aluminum strip 6 as will be described later. The aluminum strip 6 passing through the heat treatment apparatus 1 in a floating mode is heated by the heating apparatus 2 and then cooled by the slow cooling apparatus 12 and cooling apparatus 21. In FIG. 1, a heating zone, a slow cooling zone and a cooling zone are indicated at 26, 27, and 28, respectively. In the present specification, a section composed of the slow cooling zone and the cooling zone is called a cooling section.

Figure 4:
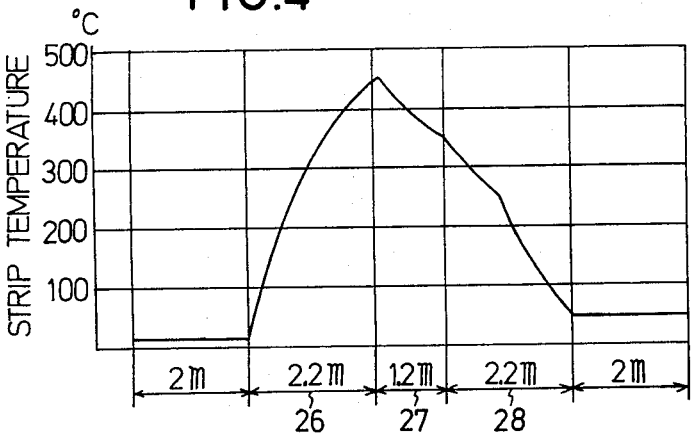
FIG. 4 is a graphic representation showing changes in temperature of the aluminum strip.

The temperature of the aluminum strip 6 subjected to heat treatment as described above changes as shown in FIG. 4 by way of one example. The dimension of the aluminum strip is 0.3 t×2000 w, the temperature of hot gas blown out of the plenum chamber 7 of the heating apparatus 2 is 500° C.; the temperature of gas from the slow cooling apparatus 12 is 220° C.; and air at 20° C. is blown out of the plenum chamber 22 of the cooling apparatus 21. Further, the length from a sealing roll disposed frontwardly of the entrance port 4 to the entrance port 4 is 2 m; the length of the heating zone is 2.2 m; the length of the slow cooling zone is 1.2 m; the length of the cooling zone is 2.2 m; and the length from the discharge port 25 to a sealing roll disposed rearwardly of the discharge port is 2 m.

Figure 5:
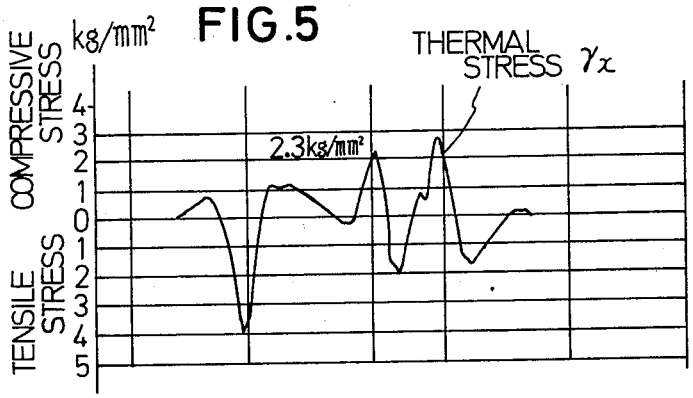
FIG. 5 is a graphic representation showing a state wherein a thermal stress is produced in the aluminum strip.

The thermal stress (the thermal stress in the width of the strip) produced in the center in the width of the aluminum strip 6 during the process wherein the aluminum strip 6 is heated, slow-cooled and cooled in a manner as described above assumes a small value as shown in FIG. 5. Thus, the aluminum strip never produces a marked strain.

Figure 6:
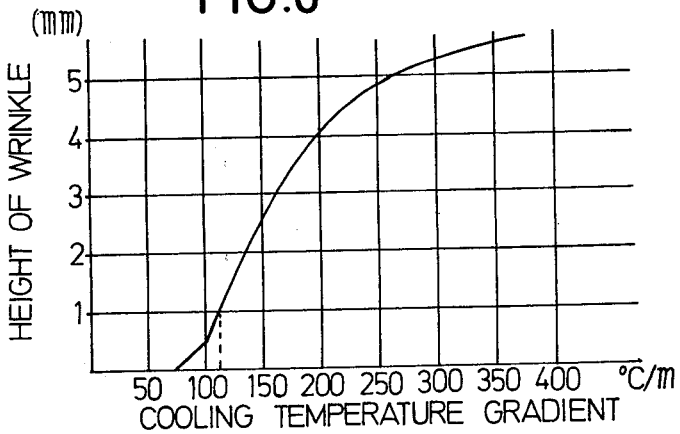
FIG. 6 is a graphic representation showing the relationship between the cooling temperature gradient and the height of wrinkle.

FIG. 6 shows the relationship between the cooling temperature gradient in the slow cooling zone and the magnitude of the strain produced in the aluminum strip or the height of wrinkles, encountered in the case the aluminum strip is cooled from 500° C. in the slow cooling zone. It is understood from FIG. 6 that in the case the cooling temperature gradient is less than 110° C./m, the wrinkles are low in height to obtain good products, and in the case the gradient is less than 70° C./m, no wrinkle is produced.

Figure 7:
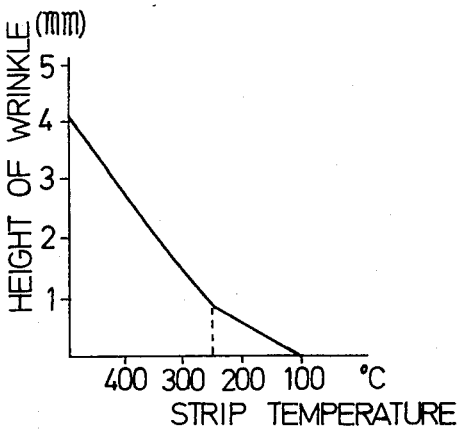
FIG. 7 is a graphic representation between the temperature of strip and the height of wrinkle.

FIG. 7 shows the relationship between the temperature of the strip at commencement of cooling and the height of wrinkles produced by such cooling, encountered in the case the strip is cooled at the cooling temperature gradient of 200° C./m in the cooling zone. It is understood from FIG. 7 that in the case the temperature of the strip is below 250° C., the wrinkles are low in height to obtain good products.

Desirable conditions required in the case the strip is slow-cooled in the slow cooling zone may be obtained from data as noted above. That is, it will be understood that during the time of the aluminum strip temperature from 550° C. down to 250° C., if the strip is cooled (slow-cooled) at the cooling temperature gradient below 110° C./m, it is possible to obtain good products with less strain.

Figure 8:
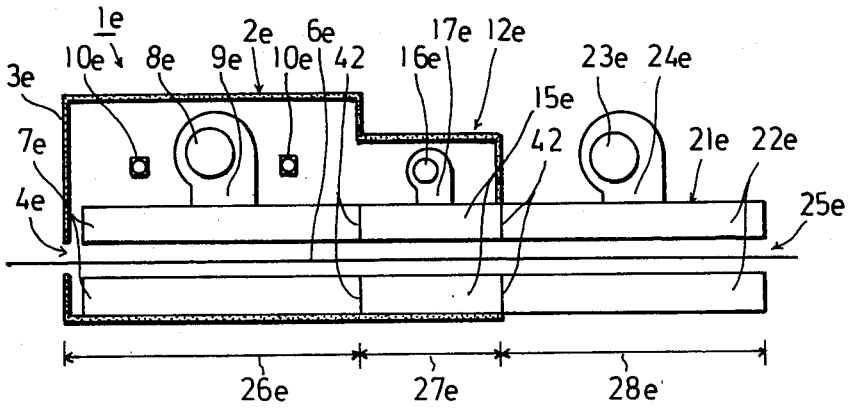
FIG. 8 is a longitudinal sectional view showing another embodiment.
Figure 9:
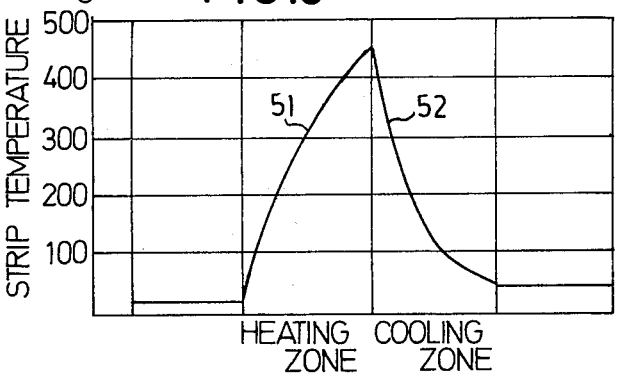
Figure 10:
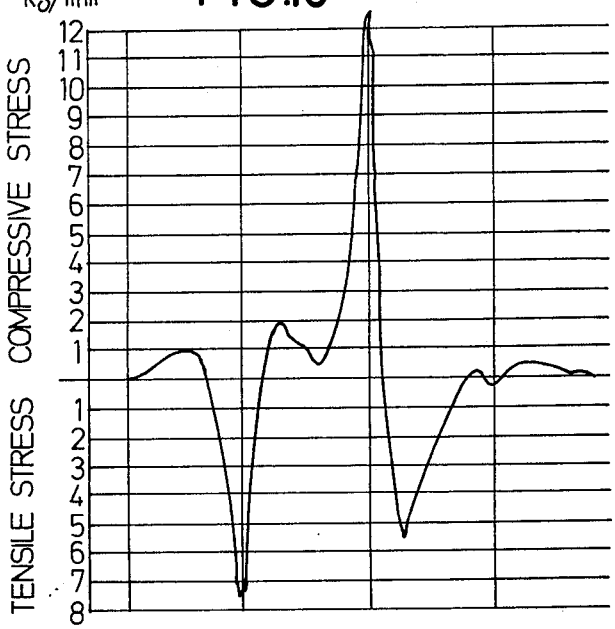
Figure 11:
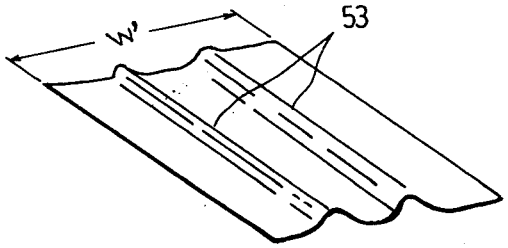

Next, FIG. 8 illustrates a further embodiment of the present invention. In this embodiment, a plenum chamber **7*e*, a plenum chamber 15*e* and a plenum chamber 22*e* in a heating zone 26*e*, a slow-cooling zone 27*e* and a cooling zone 28*e*, respectively, constitute a series of chambers, within which are provided partitioning walls 42** to divide the heating zone, the slow-cooling zone and the cooling zone.

Also, in the apparatus of construction as described, an aluminum strip **6*e*** is subjected to a series of heat treatment comprising heating, slow-cooling and cooling, similarly to the preceding embodiments.

In the illustrated embodiment, those parts considered to be identical or equal to those shown in the preceding drawing in function bear like reference numerals with an alphabet "e" affixed thereto, and double description will not be given.

It will be noted that in the embodiments described in the specification of the present invention, plenum chambers are used in a heating device, a slow-cooling device, and a cooling device. However, it is also possible to employ any other structure of common use which can float an aluminum strip and apply heat treatments such as heating, cooling or the like thereto, in place of the aforementioned plenum chambers.

What is claimed is:

1. A method for cooling an aluminium strip after heat treatment comprising the steps of:

(i) passing hot aluminium strip in floating mode through a first cooking zone in which the strip is cooled by a floating mode gas at a gradient not exceeding 110° C./m until the temperature of the strip has been lowered to 250° C., and (ii) thereafter passing the strip in floating mode through a second cooling zone in which the strip is cooled by floating mode gas at a gradient exceeding 110° C./m to a temperature less than 250° C.

2. A method, for cooling an aluminium strip after heat treatment, as claimed in claim 1, wherein said floating mode gas is blown against upper and lower surfaces of the strip.

3. A method of heat treating aluminium strip which comprises the steps of:

(a) passing aluminium strip through a heating zone in which the strip is heated by a floating mode gas to a temperature exceeding 250° C., (b) thereafter passing said heated strip in floating mode through a first cooling zone in which the strip is cooled by floating mode gas at a gradient not exceeding 110° C./m until the temperature of the strip has been lowered to 250° C., and (c) thereafter passing the strip in floating mode through a second cooling zone in which the strip is cooled by floating mode gas at a gradient exceeding 110° C./m to a temperature less than 250° C.

4. The method claimed in claim 3 wherein the floating mode gas of each zone is blown against upper and lower surfaces of the strip.

* * * * *

UNITED STATES PATENT AND TRADEMARK OFFICE

CERTIFICATE OF CORRECTION

PATENT NO. : 4,257,829

DATED : March 24, 1981

INVENTOR(S) : Hiromu Yoshimoto et al.

It is certified that error appears in the above-identified patent and that said Letters Patent are hereby corrected as shown below:

On the title page, Item [73] should read:

-- Assignee: Daidotokushuko Kabushikikaisha, Japan
and
Sumitomokeikinzokukogyo Kabushikikaisha, Japan,
a part interest. --

Signed and Sealed this

*Sixth* Day of *April 1982*

[SEAL]

*Attest:*

GERALD J. MOSSINGHOFF

*Attesting Officer*

*Commissioner of Patents and Trademarks*